US008398032B2

(12) United States Patent
Higgins

(10) Patent No.: US 8,398,032 B2
(45) Date of Patent: Mar. 19, 2013

(54) GUTTER AND MOUNTING DEVICE FOR BUILDINGS

(75) Inventor: Brian John Higgins, Cessnock (AU)

(73) Assignee: Guttering No Brackets Pty Ltd, Cessnock, New South Wales (AU)

( * ) Notice: Subject to any disclaimer, the term of this patent is extended or adjusted under 35 U.S.C. 154(b) by 0 days.

(21) Appl. No.: 10/553,666

(22) PCT Filed: Apr. 15, 2004

(86) PCT No.: PCT/AU2004/000500

§ 371 (c)(1),
(2), (4) Date: Aug. 1, 2006

(87) PCT Pub. No.: WO2004/092509

PCT Pub. Date: Oct. 28, 2004

(65) Prior Publication Data

US 2007/0095995 A1 May 3, 2007

(30) Foreign Application Priority Data

Apr. 17, 2003 (AU) ..... 2003901830
Aug. 6, 2003 (AU) ..... 2003904124

(51) Int. Cl.
*E04D 13/0641* (2006.01)

(52) U.S. Cl. ..... 248/48.1; 52/11; 52/12

(58) Field of Classification Search ..... 248/48.1; 52/11, 12, 15
See application file for complete search history.

(56) References Cited

U.S. PATENT DOCUMENTS

| | | | | | |
|---|---|---|---|---|---|
| 3,612,453 | A | | 10/1971 | Zimmer | |
| 3,864,882 | A | * | 2/1975 | Lasscock | 52/11 |
| 4,951,430 | A | | 8/1990 | Gottlieb | |
| 5,740,633 | A | * | 4/1998 | Champagne | 52/11 |
| 5,960,591 | A | * | 10/1999 | Schluter | 52/11 |
| 6,092,339 | A | * | 7/2000 | Hall et al. | 52/11 |

FOREIGN PATENT DOCUMENTS

| | | | |
|---|---|---|---|
| AU | 41273 68 | | 1/1971 |
| AU | 32112 | | 2/1973 |
| AU | 65538 80 | | 7/1981 |
| AU | 198824977 | A1 | 5/1987 |
| GB | 2 364 339 | A | 1/2002 |
| WO | WO 02/090686 | A1 | 11/2002 |

* cited by examiner

*Primary Examiner* — Nkeisha Smith
(74) *Attorney, Agent, or Firm* — The Webb Law Firm

(57) ABSTRACT

A mounting bracket for a gutter for buildings, the gutter including a generally channel or trough shaped body for collecting water with an internal wall having mounting means thereon, the mounting bracket including an elongated bracket body which includes an attachment section which is attachable to the building and a gutter mounting section, the gutter mounting section including a plurality of gutter support elements arranged along the gutter mounting section and aligned so as to correspond to a fall required when the gutter is in an installed position.

21 Claims, 3 Drawing Sheets

FIG. 3
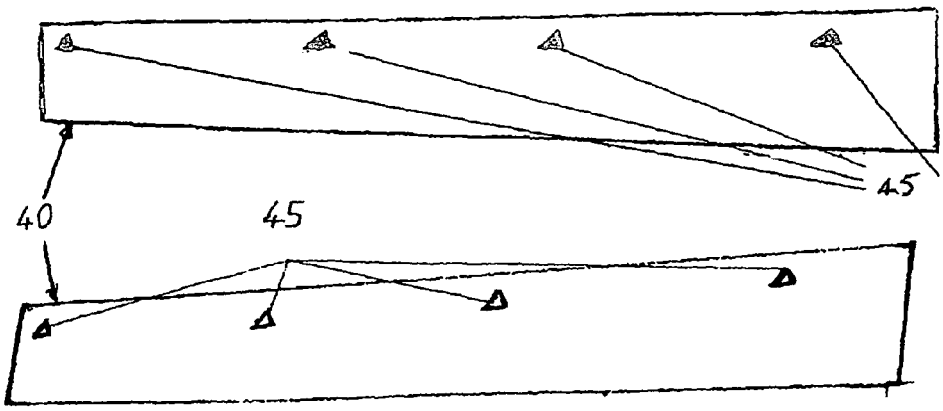
FIG. 4
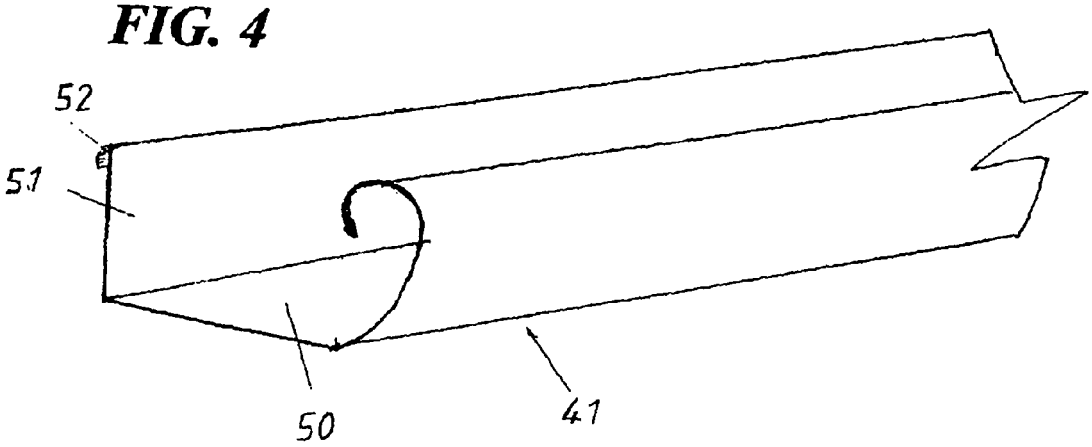
FIG. 5

FIG. 6
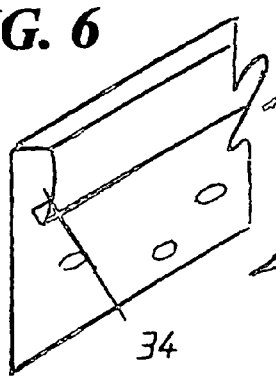
FIG. 7
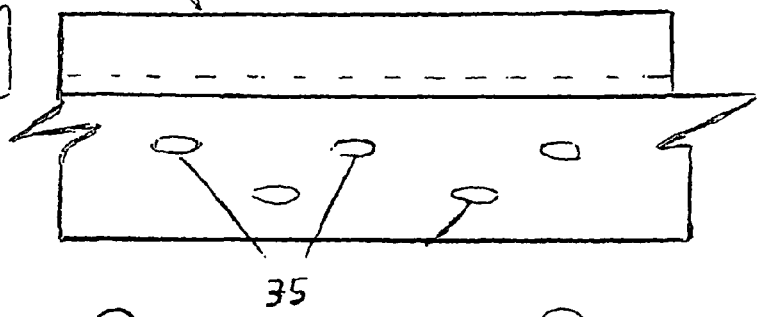
FIG. 8
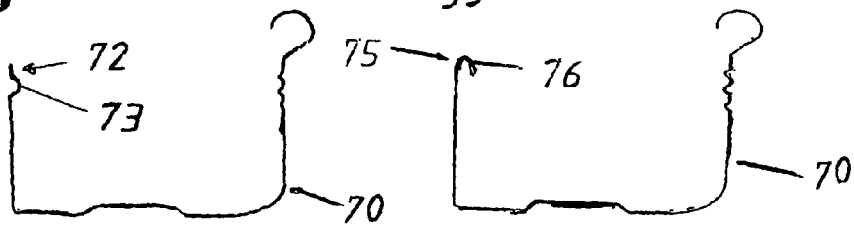
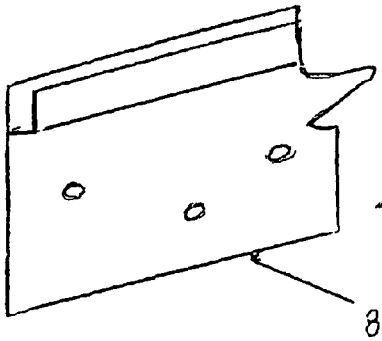
FIG. 9
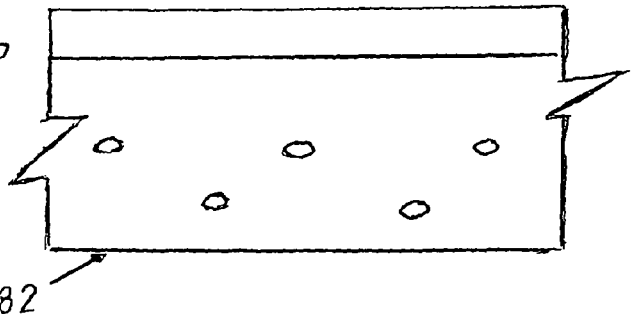
FIG. 10
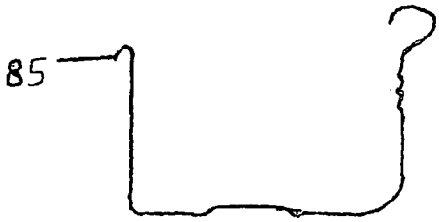
FIG. 11

GUTTER AND MOUNTING DEVICE FOR BUILDINGS

BACKGROUND OF THE INVENTION

1). Field of the Invention

This invention relates generally to guttering for buildings and the like and to components therefor.

2). Prior Art

One form of currently known guttering includes a channel shaped body which is adapted to be mounted to a building by a series of separate support brackets. A problem associated with existing guttering is that it is a relatively time consuming task to mount the guttering to the building because of the requirement that the guttering has a proper fall enabling water in the guttering to be directed to the down pipe. This requires the setting of a string line at the desired fall angle and thereafter mounting brackets correctly so that the channel will follow the fall line.

It is an object of present invention to provide improvements to guttering which alleviates one or more of the aforementioned disadvantages.

SUMMARY OF THE INVENTION

According to one aspect of the present invention there is provided a mounting bracket for a gutter for buildings, the gutter including a generally channel or trough shaped body for collecting water with an internal wall having mounting means thereon, the mounting bracket including an elongated bracket body which includes an attachment section which is attachable to the building and a gutter mounting section, the gutter mounting section including a plurality of gutter support elements arranged along the gutter mounting section and aligned so as to correspond to a fall required when the gutter is in an installed position.

In one preferred form, the elongated bracket body includes a generally U-shaped portion one leg thereof being the attachment section and the other leg thereof being the gutter mounting section. Preferably, the legs of the U-shaped portion are spaced apart so as to provide a recess therebetween for receiving part of the internal wall of the gutter therein when the gutter is in the installed position.

The gutter support elements may, in one form include projections which extend into the recess and are adapted to cooperate with the mounting means on the internal wall of the gutter so as to retain the gutter in the installed position. The mounting means on the internal wall of the gutter may be in the form of a raised elongated rib which in the installed position is disposed within the recess and inhibited from removal by said projections. Preferably, the projections are hook-like elements pressed or punched out of the gutter mounting section.

The mounting bracket may further include a plurality of access apertures in the gutter mounting section for providing access to the attachment section when it is being attached to the building.

BRIEF DESCRIPTION OF THE DRAWINGS

Preferred embodiments of the invention will hereinafter be described with reference to the accompanying drawings and in those drawings:

FIGS. 3 and 4 are side views of gutter mounting brackets according to other embodiments of the present invention;

FIG. 5 is a schematic view of a gutter suitable for use with the brackets shown in FIGS. 3 and 4;

FIGS. 6, 7, 8(*a*) and 8(*b*) are schematic views of a bracket and gutter according to another embodiment of the invention; and FIGS. 9, 10 and 11 are schematic views of a gutter and bracket according to further embodiments of the invention.

DETAILED DESCRIPTION OF THE INVENTION

Figure 1:
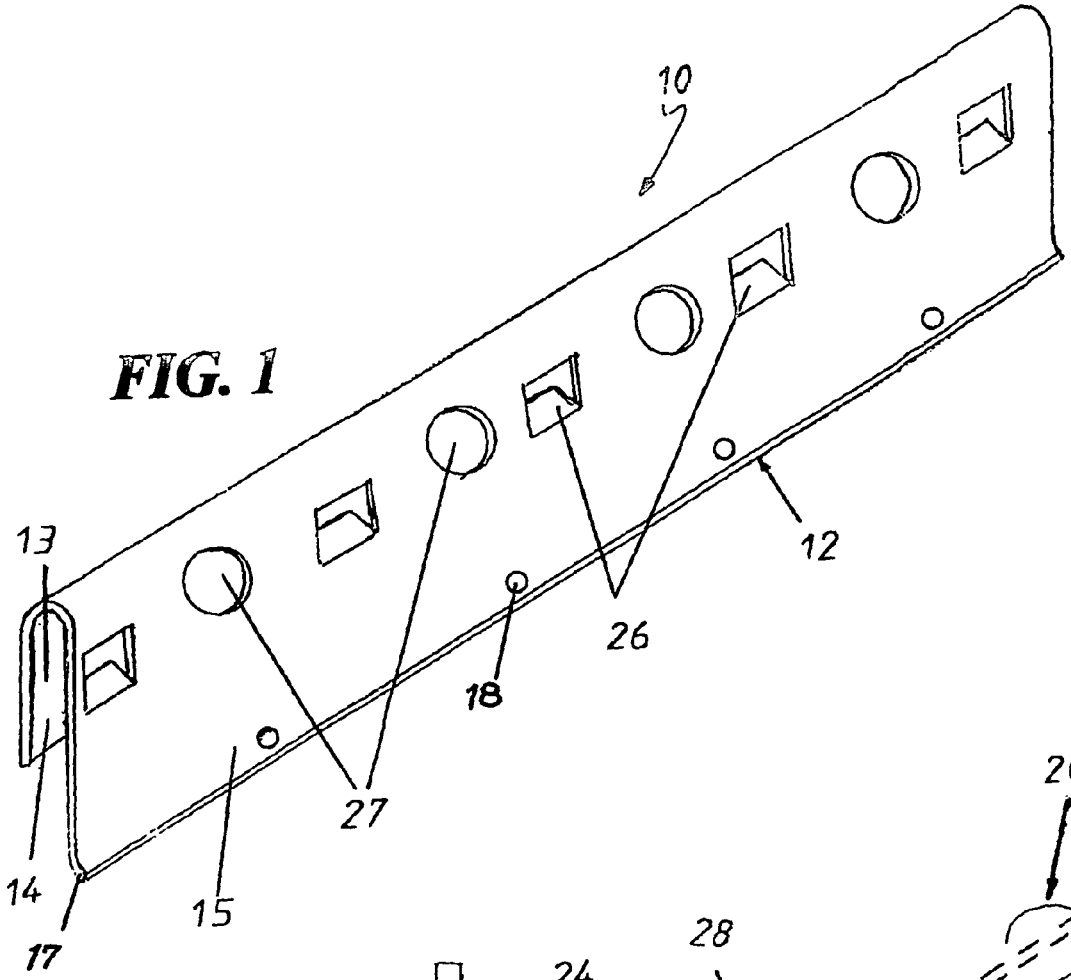
FIG. 1 is a schematic isometric illustration of a gutter mounting bracket according to one preferred embodiment of the present invention.
Figure 2:
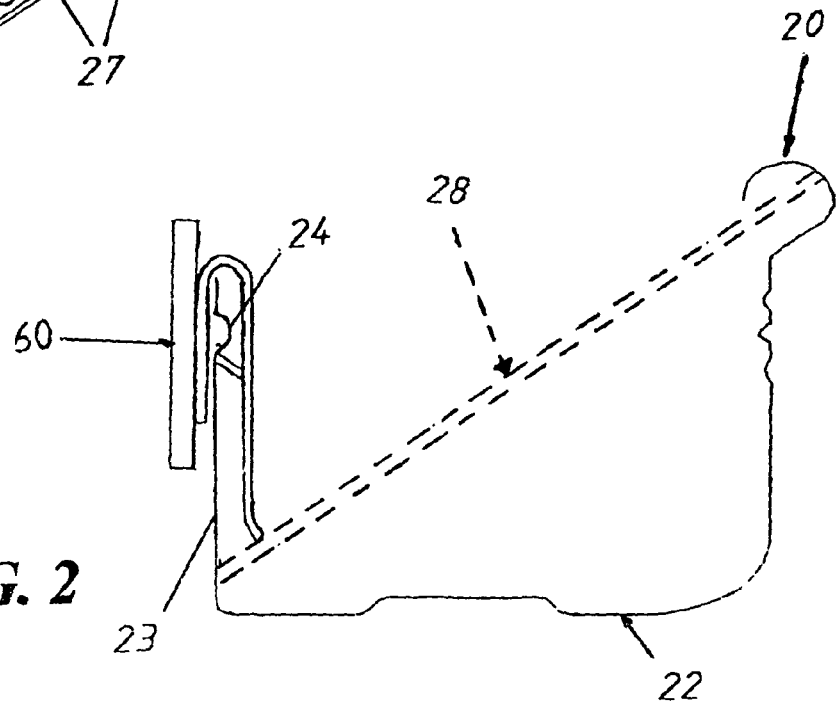
FIG. 2 is a schematic side view of the bracket shown in FIG. 1 and a gutter in an installed position.

Referring to FIGS. 1 and 2, there is shown a mounting bracket 10 for a gutter 20 for buildings. As shown in FIG. 2, the gutter 20 includes a generally channel shaped body 22 for collecting water with an internal wall 23 having mounting means 24 thereon. The mounting bracket 10 includes an elongated bracket body 12 which includes an attachment section 14 which is attachable to the building which, as shown in this example, is fascia 60 and a gutter mounting section. It could be also attached to other parts of the building such as the wall or rafter. The gutter mounting section including a plurality of gutter support elements arranged along the gutter mounting section and aligned so as to correspond to a fall angle required when the gutter is in an installed position.

The elongated bracket body includes a generally U-shaped portion one leg thereof being the attachment section 14 and the other leg thereof being the gutter mounting section 15. The legs of the U-shaped portion are spaced apart so as to provide a recess 13 therebetween for receiving part of the internal wall of the gutter therein when the gutter is in the installed position. The free end 17 of gutter mounting section 15 is inclined with respect to the plane of the section providing a lead-in guide when installing the gutter.

The gutter support elements include projections 26 which extend into the recess 13 and are adapted to cooperate with the mounting means on the internal wall of the gutter so as to retain the gutter in the installed position. The mounting means on the internal wall of the gutter is a raised elongated rib 24 which in the installed position is disposed within the recess and inhibited from removal by said projections. Because section 15 extends well into the gutter when installed this reduces the prospect of uplift of the gutter. Furthermore, if desired, high tensile rods 28 may be provided at spaced intervals along the gutter for increased stability.

The projections are hook-like elements pressed or punched out of the gutter mounting section. A plurality of access apertures 27 are provided in the gutter mounting section for providing access to the attachment section when it is being attached to the building. Below each aperture 27 is a bleed hole 18 for enabling water to escape from the recess 13.

Referring to FIGS. 3 to 5 there is shown two further forms mounting bracket 40 and a gutter 41. The mounting bracket 40 includes a sheet having mounting projections 45 thereon. The sheet is tapered from one end to the other and adapted to be secured to a wall or fascia of the building with the mounting projections 45 being aligned so as correspond to the fall required in the liquid collecting section of the gutter assembly. It will be appreciated that by aligning the lower edge of the sheets shown in FIGS. 3 and 4 with an edge of the fascia, the mounting projections will be inclined relative to that edge. That is, a line extending through the projections from one end of the sheet to the other will conform to the required fall of the liquid collecting section of the guttering assembly. The gutter 41 as shown in FIG. 5 includes a trough like channel 50 having an internal side wall 51 which can be mounted to the mounting projections 45 so that in an installed position the liquid collecting section is disposed at the selected fall of gutter assembly.

The mounting projections 45 are triangular or square shaped hook like elements pressed or punched out of the mounting section. The hook-like elements are adapted to cooperate with a hook shaped edge portion 52 on internal side wall at the upper edge thereof so that the gutter can be attached to the mounting section. Strap elements (not shown) may be disposed along the length of the guttering to support the gutter particularly when it contains water.

Referring to FIGS. 6 to 8 there is shown another form of mounting bracket and guttering according to the present invention. In this particular form there is provided a mounting bracket 32 and gutter 70, two forms of which are illustrated in FIGS. 8(*a*) and 8(*b*). The mounting bracket 32 is in the form of a sheet which is adapted to be secured to a wall or fascia of a building by fastenings which cooperate with mounting apertures 35. The upper edge of the sheet has a spring clip section 34 thereon which is adapted to receive coupling section 72, 75 on the gutter 70. As shown, the coupling section can be in the form of a protuberance 73 or hook shaped flange 76. The coupling section 72, 75 is adapted to snap fit into the clip section 34.

In the embodiment of FIGS. 9 and 10 the mounting bracket 82 has a U-shaped flange formed along its upper edge which is adapted to receive a hook like coupling section 85 on the gutter (FIG. 11).

Finally, it is to be understood that various alterations, modifications and/or additions may be incorporated into the various constructions and arrangements of parts without departing from the spirit or ambit of the invention.

The invention claimed is:

1. A mounting device for a gutter for buildings that extends in a first longitudinal direction, the gutter having a generally channel or trough shaped body for collecting water and having an inner wall, the mounting device comprising an elongated device body that extends in a second longitudinal direction between opposite ends, the body including:

a generally U-shaped portion having first and second spaced apart legs having opposing surfaces defining a recess therebetween for closely receiving part of the inner wall of the gutter in an installed position, the first leg of the U-shaped portion including a plurality of gutter retaining clips and a plurality of access apertures, the plurality of retaining clips and access apertures being spaced apart from one another in the second longitudinal direction and extending into the recess, the second leg of the U-shaped portion being attachable to the building with access to the second leg being provided through the access apertures in the first leg, the second leg having opposite rear and forward facing surfaces, the rear facing surface being arranged to face the building when the second leg is attached to the building and the forward facing surface being one of the opposing surfaces defining the recess so as to allow for locating of the inner wall of the gutter into the recess into the installed position when the second leg is attached to the building, and when the gutter is located in the installed position, opposite surfaces of the inner wall of the gutter are in facing relation with respective ones of the opposing surfaces of the first and second legs and the retaining clips closely cooperate with the second leg of the U-shaped portion and the inner wall of the gutter to retain the gutter to the mounting device; and wherein the mounting device is configured such that when the gutter is in the installed position, the second longitudinal direction of the elongated device body is substantially parallel to the first longitudinal direction of the gutter.

2. A mounting device according to claim 1, wherein the gutter retaining clips include projections which extend into the recess and are adapted to cooperate with the inner wall of the gutter so as to retain the gutter to the device.

3. A mounting device according to claim 2, wherein said projections are hook-like elements pressed or punched out of the first leg.

4. A mounting device according to claim 1, wherein the retaining clips are aligned parallel with respect to a single edge of the mounting device.

5. A mounting device according to claim 1, wherein the second leg is adapted to receive fasteners to secure the mounting device to a building.

6. A mounting device according to claim 1, wherein the elongated device body is channel shaped and is generally U-shaped in cross-section transverse to the longitudinal direction.

7. A mounting device according to claim 1, wherein at least two retaining clips of the mounting device are able to simultaneously engage the gutter to retain the gutter to the mounting device.

8. A mounting device according to claim 1, wherein the access apertures are provided in the first leg in an alternating arrangement with the retaining clips.

9. A gutter and mounting device for buildings, the gutter comprising:

a generally channel or trough shaped body for collecting water with an inner wall having a gutter mounting thereon, and the gutter extending in a first longitudinal direction;

the mounting device comprising an elongated body that extends in a second longitudinal direction between opposite ends, the body including:

a generally U-shaped portion having first and second spaced apart legs having opposing surfaces defining a recess therebetween for closely receiving part of the inner wall of the gutter in an installed position, the first leg of the U-shaped portion including a plurality of gutter retaining clips and access apertures, the plurality of retaining clips and the plurality of access apertures being spaced apart from one another in the second longitudinal direction and extending into the recess, the access apertures providing access to the second leg to attach the second leg to the building and, when so attached, the inner wall of the gutter and the U-shaped portion being configured so that when the gutter is located in the installed position, the opposing surfaces of the first and second legs are in direct facing relation with opposite surfaces of the inner wall and capture the gutter mounting within the recess to retain the gutter to the mounting device;

wherein the mounting device is configured such that when the gutter is in the installed position, the second longitudinal direction of the elongated device body is substantially parallel to the first longitudinal direction of the gutter.

10. A gutter and mounting device according to claim 9, wherein the gutter retaining clips include projections which extend into the recess and are adapted to cooperate with the gutter mounting on the inner wall of the gutter so as to retain the gutter in the installed position.

11. A gutter and mounting device according to claim 10, wherein the gutter mounting on the inner wall of the gutter is a raised elongated rib or turned over edge which, when the gutter is in the installed position, is disposed within the recess and inhibited from removal by said projections.

12. A gutter and mounting device according to claim 10, wherein said projections are hook-like elements pressed or punched out of the first leg.

13. A gutter and mounting device according to claim 9, wherein the retaining clips are parallel with respect to a single edge of the mounting device.

14. A gutter and mounting device according to claim 9, wherein the second leg is adapted to receive fasteners to secure the mounting device to a building.

15. A gutter and mounting device according to claim 9, wherein the body is channel shaped and is generally U-shaped in cross-section transverse to the longitudinal direction.

16. A gutter and mounting device according to claim 9, wherein at least two retaining clips are able to simultaneously engage the gutter to retain the gutter to the mounting device.

17. A gutter and mounting device according to claim 9, wherein the access apertures are provided in the first leg in an alternating arrangement with the retaining clips.

18. A method of installing a gutter that extends in a first longitudinal direction, the gutter having a generally channel or trough shaped body for collecting water and having an inner wall having a gutter mounting thereon, the method comprising the steps of:

attaching a mounting device to a generally planar surface of a building, the mounting device comprising an elongated device body including a generally U-shaped portion having first and second legs, the legs of the U-shaped portion being spaced apart so as to provide a recess therebetween for closely receiving the inner wall of the gutter with opposite surfaces of the inner wall of the gutter being in facing relation with respective legs of the U-shaped portion, the elongated device body extending in a second longitudinal direction between opposite ends and including a plurality of retaining clips and a plurality of access apertures on the first leg that are spaced apart in the second longitudinal direction and extend into the recess, the access apertures providing access to the second leg to attach the second leg to the building surface, the mounting device being positioned on the building so that the U-shaped portion is disposed adjacent to the surface of the building and the mounting device is aligned so as to correspond to an angle of a fall required when the gutter is in an installed position; and mounting the gutter to the device when attached to the building surface by moving the gutter to the installed position where the inner wall of the gutter extends into the recess and the retaining clips on the first leg capture the gutter mounting in the recess so as to retain the gutter in the installed position, wherein in the installed position, the first longitudinal direction of the gutter is substantially parallel to the second longitudinal direction of the elongated device body.

19. A method of installing a gutter according to claim 18, wherein the retaining clips of the mounting device are parallel with respect to a single edge of the mounting device, and the step of attaching the mounting device to the building further comprises locating the single edge of the mounting device at an angle to an edge of the building to correspond to the fall required when the gutter is in the installed position.

20. A method of installing a gutter according to claim 18, wherein the step of mounting the gutter to the mounting device further comprises causing at least two retaining clips to simultaneously engage the gutter.

21. A method of installing a gutter according to claim 18, wherein the access apertures are provided in the first leg in an alternating arrangement with the retaining clips.

* * * * *

UNITED STATES PATENT AND TRADEMARK OFFICE

CERTIFICATE OF CORRECTION

PATENT NO. : 8,398,032 B2
APPLICATION NO. : 10/553666
DATED : March 19, 2013
INVENTOR(S) : Brian John Higgins It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 337 days.

Signed and Sealed this
First Day of September, 2015

Michelle K. Lee

Michelle K. Lee
*Director of the United States Patent and Trademark Office*